US005318218A

United States Patent [19]

Mattson

[11] Patent Number: 5,318,218

[45] Date of Patent: Jun. 7, 1994

[54] LATCH FOR CONTAINER

[75] Inventor: Larry J. Mattson, Charlotte, N.C.

[73] Assignee: Roberts Systems, Inc., Charlotte, N.C.

[21] Appl. No.: 978,123

[22] Filed: Nov. 18, 1992

Related U.S. Application Data

[63] Continuation-in-part of Ser. No. 964,790, Oct. 21, 1992.

[51] Int. Cl.[5] ..... B65D 43/22

[52] U.S. Cl. ..... 229/117.24; 229/125.21; 229/227; 292/137

[58] Field of Search ..... 292/137, 327, 334; 229/117.09, 117.24, 125.21, 149, 225, 227

[56] References Cited

U.S. PATENT DOCUMENTS

| | | | |
|---|---|---|---|
| 1,171,228 | 2/1916 | Misroch et al. . | |
| 2,354,498 | 7/1944 | Brown | 229/125.21 X |
| 2,388,288 | 11/1945 | Ringler et al. | 229/125.21 X |
| 2,553,840 | 5/1951 | Andre | 229/125.21 |
| 2,639,082 | 5/1953 | Goldsmith . | |
| 2,741,419 | 4/1956 | Janz | 229/125.21 |
| 3,235,167 | 2/1966 | Svensson | 229/149 X |
| 3,315,876 | 10/1965 | Vander Jagt . | |
| 3,774,836 | 11/1973 | Nunn . | |
| 3,801,012 | 4/1974 | Thelen . | |
| 3,827,624 | 8/1974 | Dogliotti | 229/149 |
| 3,910,487 | 10/1975 | Jaeschke | 229/225 |
| 3,942,712 | 3/1976 | Bundy et al. | 229/225 |
| 4,269,314 | 5/1981 | Barrash . | |
| 4,286,714 | 9/1981 | Zdarsky et al. . | |
| 4,396,128 | 8/1983 | Larson et al. . | |
| 4,498,620 | 2/1985 | Dickert et al. . | |
| 4,682,688 | 7/1987 | Budert | 229/125.21 X |
| 4,779,731 | 10/1988 | Fujio . | |
| 4,819,410 | 4/1989 | Skinner et al. . | |
| 5,052,165 | 10/1991 | Gunther . | |
| 5,079,900 | 1/1992 | Pinckney et al. . | |
| 5,106,015 | 4/1992 | Vlasaty et al. . | |
| 5,161,734 | 11/1992 | Ruehl et al. | 229/227 |

*Primary Examiner*—Allan N. Shoap
*Assistant Examiner*—Christopher McDonald
*Attorney, Agent, or Firm*—Hardaway Law Firm

[57] ABSTRACT

A reversible latching means for a recloseable container which has a plurality of tabs being deformed from a plane of the latching means in order to engage a plurality of notches on the container.

9 Claims, 8 Drawing Sheets

LATCH FOR CONTAINER

BACKGROUND OF THE INVENTION

This application is a continuation-in-part of application Ser. No. 07/964,790, filed Oct. 21, 1992, and incorporates by reference said parent application.

This invention is directed to the art of closures and more particularly to an improved means for securing a recloseable container.

A problem exists in the art of recloseable containers due to the absence of a suitable latching means. Recloseable containers, when lifted or carried or otherwise repositioned, are susceptible to spillage, causing unnecessary waste, inconvenience and cost. When spilled, products such as powdered detergents and other similar agents compromise household safety due to the difficulty of a comprehensive clean-up. In addition, any recovered product is many times non-usable after being spilled, having been contaminated by moisture or dirt particles. Further, the contents of a recloseable container that is not adequately secured is susceptible to contamination or alteration by environmental moisture at any time, even when not being actively used.

A suitable latching means is also necessary for many containers that have handles so that the container is able to be lifted. The closure further ensures the integrity of the contents of the container during lifting and carrying.

Although the prior art provides latching means of various kinds and suitabilities, there remains a need for improvement within the art of securing recloseable containers.

SUMMARY OF THE INVENTION

It is thus an object of this invention to provide a latching means for containers.

It is a further object of this invention to provide an improved latching means for containers.

It is yet another object of this invention to provide a reversible latching means for containers.

It is a further and more particular object of this invention to provide a reversible latching means that is readily accessed and easily manipulated, and reliable after repeated use.

It is a further and more particular object of this invention to provide a latching means that has a compact shipping profile.

It is a further and more particular object of this invention to provide a latching means for a container, the latching means being provided by an extension of a handle of the container.

These as well as other objects of this invention are provided by a handle and latch assembly comprising a substantially thin, planar platform, the platform having a top, a bottom, an outer perimeter and an inner region, the top and bottom further defining an opening therebetween; a strap defined by the platform's inner region, the strap traversing the opening and having a first end and a second end, the first end and second end attached to flexible hinges at each of the respective strap ends; a latch having a first end carried by the handle and a second free end, the first end positioned against an inner portion of a margin of a hinged container lid, the second end of the latch defining a tab, the tab being deformable from a plane of the tab; a notch defined by an exterior surface of the container; wherein the handle is fastened to a container top, the hinged top reversibly engaging the container, the tab of the latch positioned in close proximity to the notch, the tab engaging the notch thereby reversibly securing said recloseable closure and handle to the container.

DETAILED DESCRIPTION

In accordance with this invention, it has been found that containers having recloseable tops can be improved by providing a latching means which offers advantages over closures described in the prior art. The latching means of the present invention can be manufactured from a readily recyclable material such as plastic, has a slim profile, and can be mounted independently or in conjunction with a handle for a container. It is easy to manipulate and is sturdy for repeated use.

Figure 1:
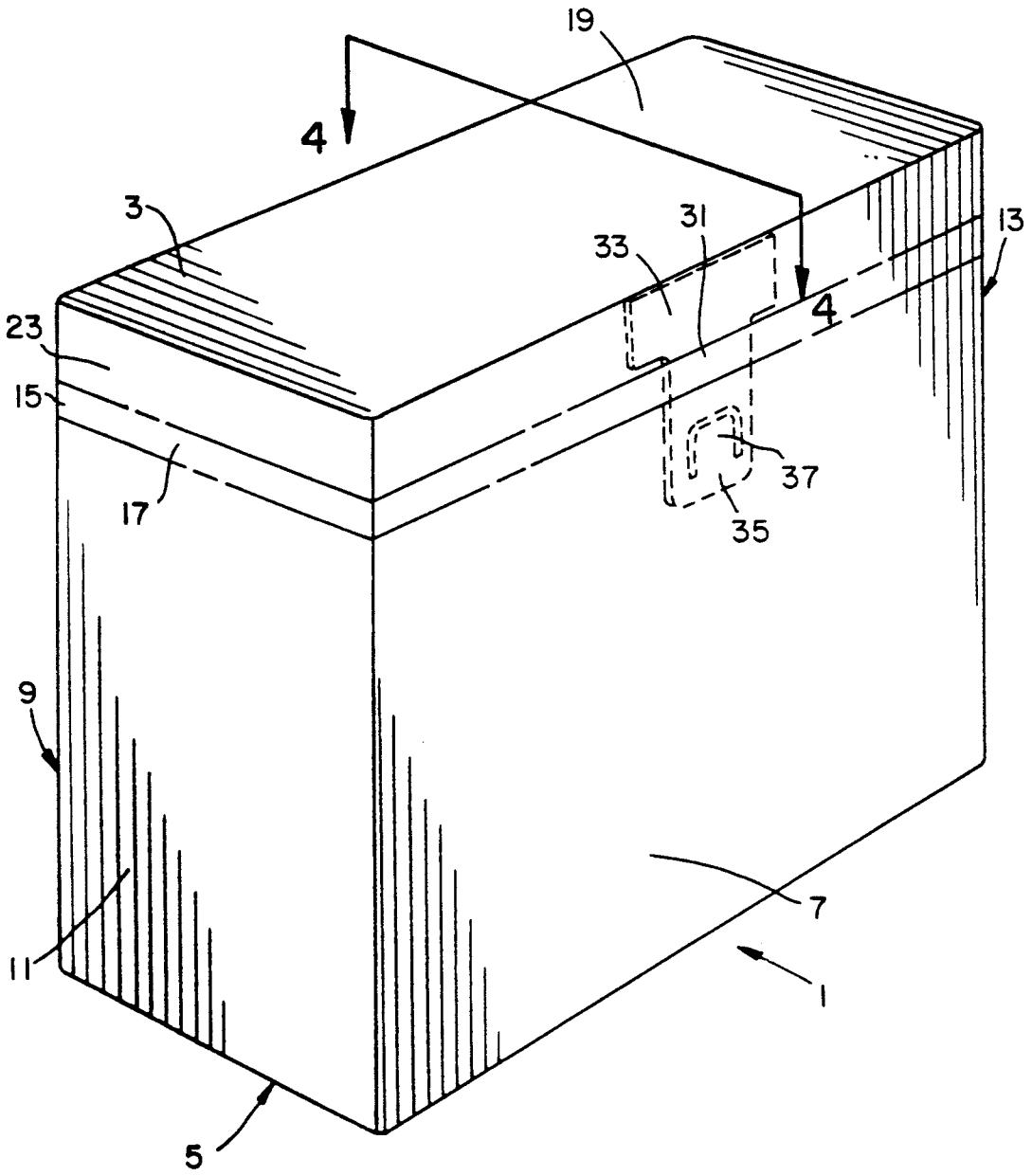
FIG. 1 of the drawings is a perspective view in partial phantom of a preferred embodiment of this invention.
Figure 4:
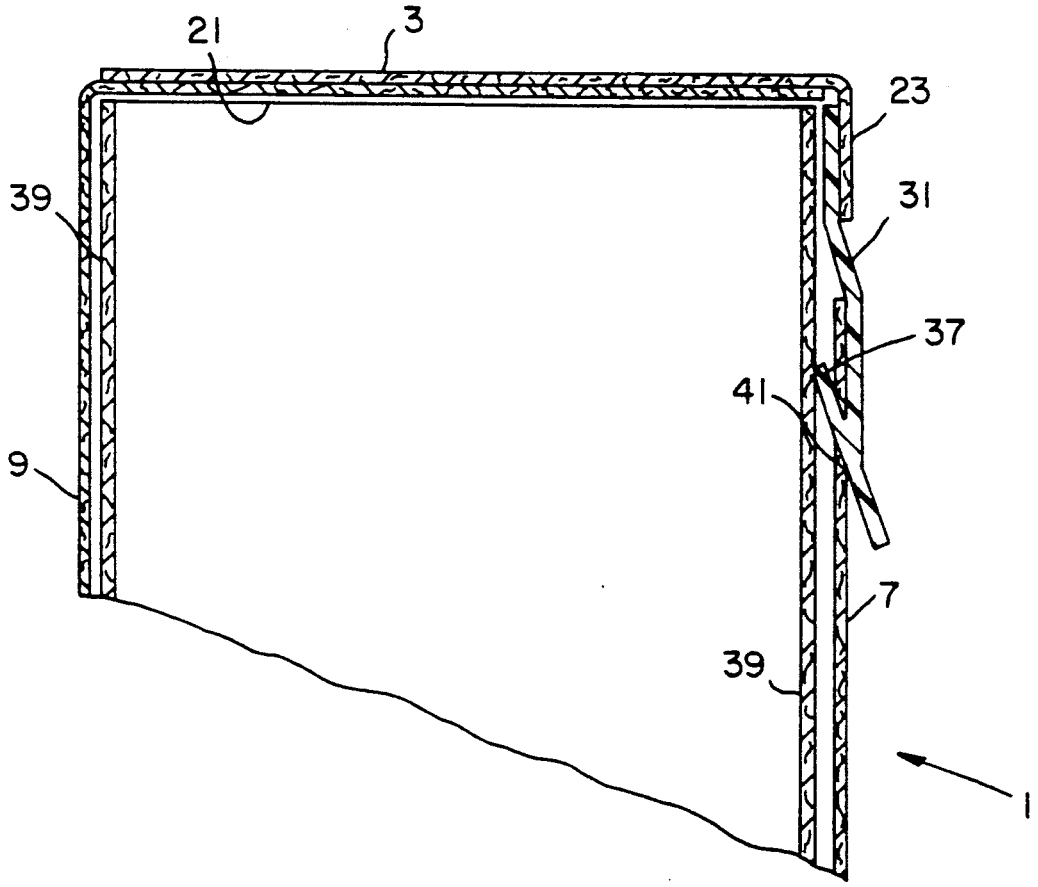
FIG. 4 of the drawings is a vertical median sectional view taken along the plane indicated by the section line 4—4 of FIG. 1, showing a preferred embodiment of the latching means of this invention engaging the front surface of a container.

As seen in FIG. 1 of the drawings, a preferred embodiment of container shown sealed as in shipping, comprises a recloseable closure having a top 3, bottom 5, front 7, back 9, first side 11 and second side 13. When tear strip 17 is pulled, disconnecting recloseable top 3 from first side 11, front 7 and second side 13, top 3 is carried by back 9 at hinge 15. Top 3 further comprises outer surface 19, inner surface 21 (not shown) and circumferential margin 23 which projects below a plane of inner surface 21 (as best seen in FIG. 4).

Also illustrated in FIG. 1 is a latch 31, shown in phantom, having a first end 33 positioned against an inner portion of margin 23, and having a second end 35 defining a tab 37 which is deformable from a plane of latching means 31. Latching means 31, as best seen in FIGS. 2 through 6, is exposed and available for use upon pulling and removing tear strip 17. Likewise, inner liner 39, as seen in FIGS. 2 through 6, is exposed upon pulling and removing tear strip 17.

There is distinct advantage to having the latching means of a container to be initially enclosed within the packaged product, i.e. having latching means 31 initially positioned between inner liner 39 and front 7. Such arrangement does not hinder the motion of a mechanically moving container, which could contribute to its ripping apart, or add to its dimensions or requirements when shipped or stored.

Latching means 31 can be secured against margin 23 or, if used in conjunction with a secured handle, may be an extension of such handle and may or may not need to be independently secured.

Figure 2:
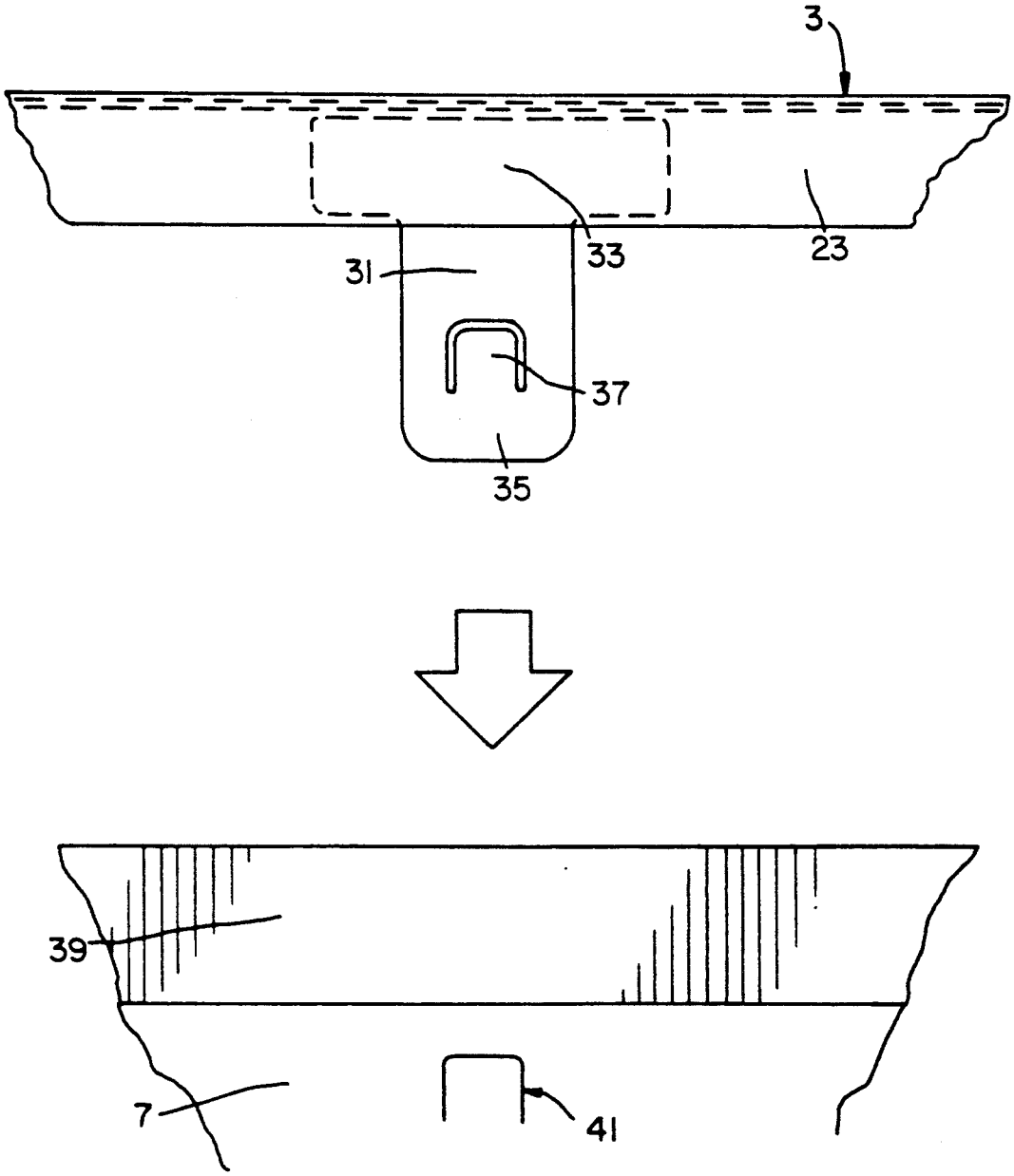
FIG. 2 of the drawings is a detail view of the preferred embodiment seen in FIG. 1 showing the recloseable top of a container in an open position with the latching means non-engaged.

As seen in FIG. 2, tear strip 17 (not shown) has been pulled and removed, allowing recloseable top 3, illustrated in open position, to be detached from sides 11 and 13 (not shown) and front 7 of container 1. First end 33 of latching means 31 is shown in phantom against circumferential margin 23, and second end 35 of latching means 31 is seen having been displaced from its original position between inner liner 39 and front 7 (see FIG. 1). When top 3 engages container 1, second end 35 of latching means 31 comes in close proximity to notch 41 on front 7. Thereafter, tab 37, deformable from a plane of latching means 31, can engage notch 41, thereby reversibly securing recloseable top 3.

Latching means 31 is constructed of a unitary piece of tear resistant polymer, such as recycled polyethylene; container 1 and its inner liner 39 are typically constructed of cartonboard or cardboard stock. One preferred liner 39 defines a plurality of notches 43, best seen in FIGS. 5 and 6, for possible engagement with one or more deformable tabs 37.

Figure 3:
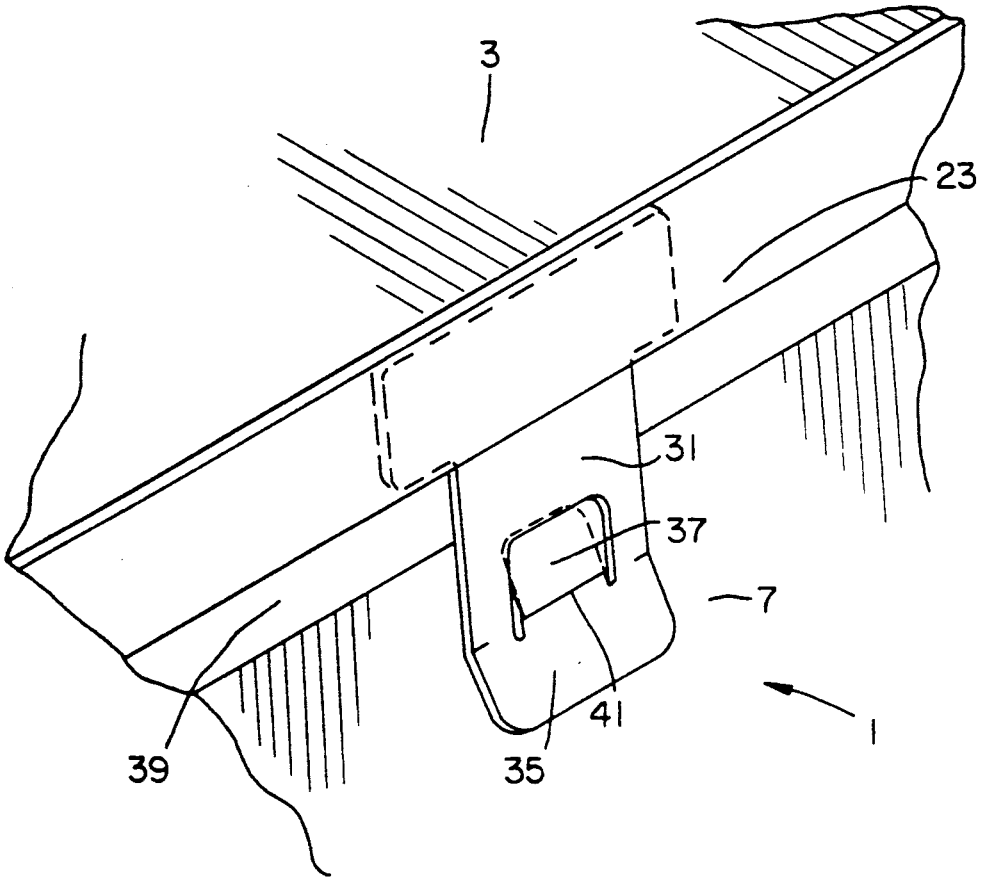
FIG. 3 of the drawings is a detail view of the preferred embodiment of FIG. 1 showing the recloseable top in closed position and the latching means engaging the associated notch on the container.

FIG. 3 of the drawings illustrates recloseable top 3 engaging container 1 after tear strip 17 (not shown) has been pulled to expose inner liner 39. Second end 35 of latching means 31 is positioned external to front 7, and deformable tab 37 is seen in phantom, engaged with notch 41. When tab 37 engages notch 41, container 1 is secured by latching means 31 and the container contents is protected from spillage and/or contamination.

Figure 5:
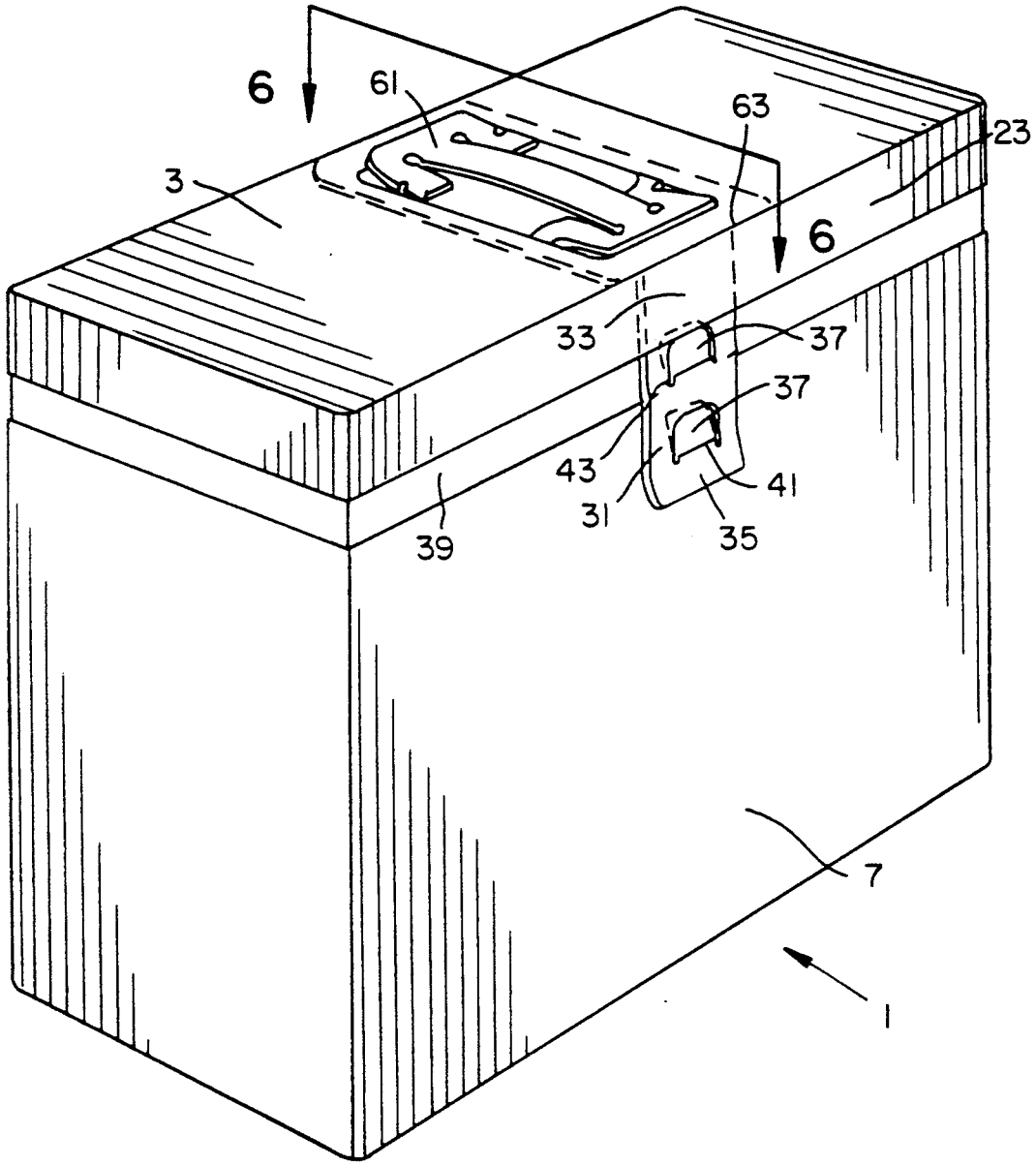
FIG. 5 of the drawings illustrates a second preferred embodiment of the latching means of this invention.
Figure 6:
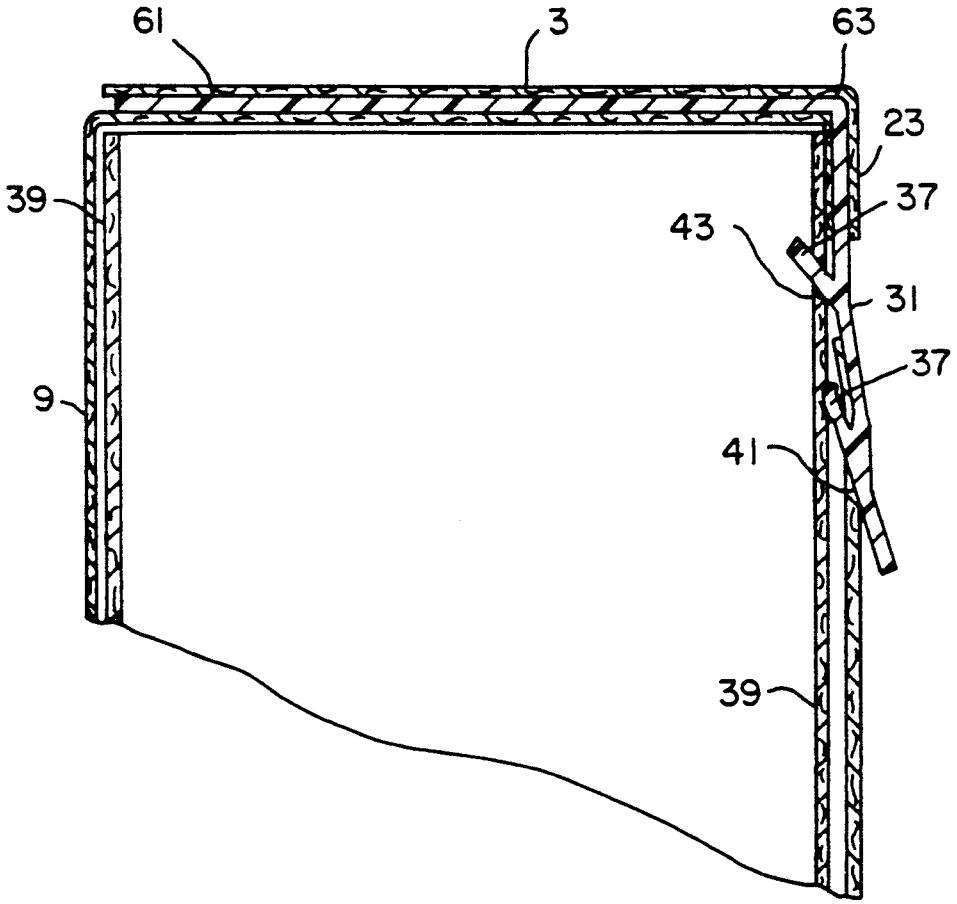
FIG. 6 of the drawings is a vertical median sectional view taken along the direction indicated by the line 6—6 of FIG. 5 also showing a second preferred embodiment of the latching means of this invention.

In FIG. 4 of the drawings, deformable tab 37 of latching means 31 is shown engaging notch 41 and passing through front 7 of container 1 to lodge between inner liner 39 and front 7, thus securing recloseable top 3. Once secured in this manner by latching means 31, the container 1 can be lifted and carried with assurance for the safety of its contents. As illustrated in FIGS. 5 and 6, latching means 31 is secured to the inner surface of margin 23 of top 3.

Illustrated in FIG. 5 of the drawings is another preferred embodiment of the latching means 31 shown with multiple deformable tabs 37 in phantom. First tab 37 engages a notch 41 in front surface 7 of container 1, and a second tab 37 engages a notch 43 in inner liner 39.

Tabs 37 can be employed in various combinations in addition to that described above. For example, single tab 37 could engage a notch 41 on the front of the container and further engage a notch 43 on inner liner 39 directly adjacent notch 41, allowing the one tab 37 to pass through both front surface 7 of container 1 and the inner liner 39 of container 1. Another preferred arrangement would have one tab 37 engage notch 41 of front 7 and likewise engage notch 43 of inner liner 39 directly adjacent notch 41, and a second tab 37' engage an additional notch 43' on the exposed inner liner 39. The use of multiple tabs increases the security of the latching means, ensuring to an even greater degree the integrity of the contents of the container.

In addition, the preferred embodiment seen in FIGS. 5 and 6 provides that latching means 31 is an extension of handle 61, handle 61 being the subject matter of the parent application incorporated earlier by reference. Such arrangement provides a unitary construction of handle 61 and latching means 31, connected at flexible hinge 63. Such unitary construction is typically secured to top 3 of container 1 at handle 61, allowing first end 33 of latching means 31 to be positioned against the inner surface of margin 23 of top 3. Second end 35 of latching means 31 extends beneath a plane of margin 23 in order that tabs 37 are available to engage notch 41 of front end 7 and notch 43 of inner liner 39.

FIG. 6 of the drawings further illustrates the unitary construction of handle 61, latching means 31, and flexible hinge 63 therebetween, as seen in FIG. 5. In FIG. 6, first tab 37 of latching means 31 engages notch 41 in front 7 of container 1, and second tab 37' engages notch 43 in inner liner 39. The latching means is made stronger by the use of such multiple tabs, thereby increasing the security of recloseable container 1 after it has been opened.

Figure 7:
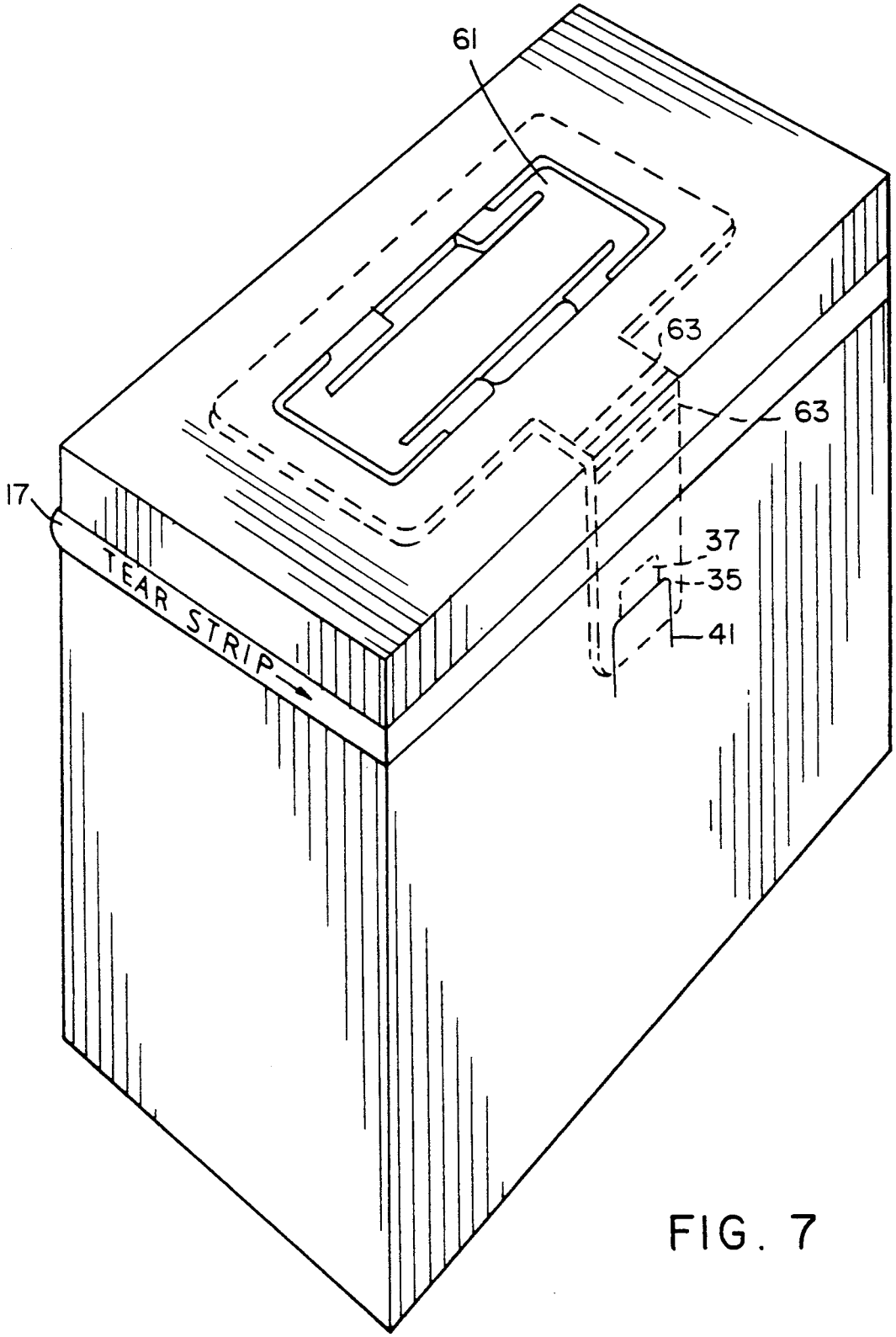
FIG. 7 of the drawings is an additional embodiment of the invention showing a handle and latch assembly.

As seen in FIG. 5, a score line provides a hinged connection 63 between the handle and the latch. While the latch can be carried along any exterior side of the handle, a preferred embodiment of the latch and handle assembly is seen in FIG. 7 where the handle 61 is positioned lengthwise along the length of the container lid. A plurality of score lines 63 define the hinged connection between the handle and the latch.

This preferred embodiment allows a larger size handle to be used with the container than if a handle was installed lengthwise along the narrower width of a container lid. Further, the plurality of score lines permit the single sized handle/latch assembly to be used with a range of different sized containers, the scored hinges adapting to changes in a container or lid width.

Figure 8:
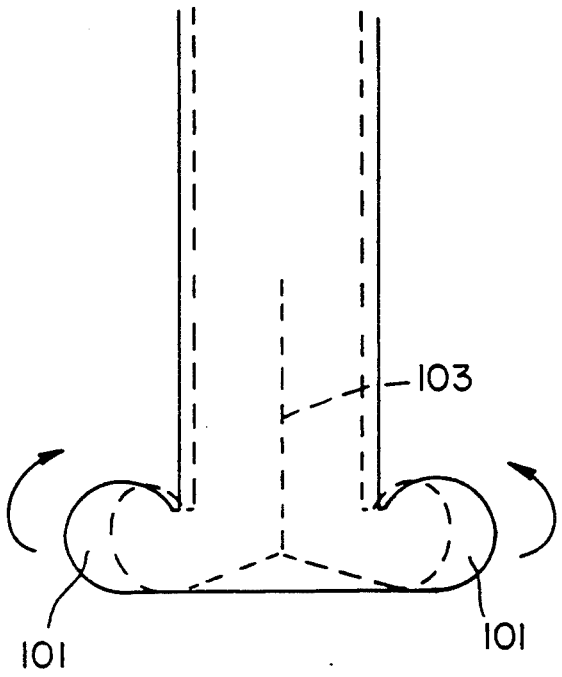
FIG. 8 of the drawings is an additional embodiment of the engaging portion of a latch.

In FIG. 8, an embodiment of a latch with a pair of lateral tabs 101 which extend from the second latch end is provided. Appropriately shaped and positioned notches (not shown) of a container can engage the tabs by the flexing of the latch along a flexible score line 103, thereby permitting the insertion of the tabs into a pair of opposing carton notches. Various containers can be provided which do not include inner liners of the kind described thus far. For example, the contents of a container (e.g., dog food) may be of such sufficient bulk and consistency so as not to require a separate liner, employing instead a waxed inner surface of the container to protect against moisture from the product seeping into the container wall. Alternatively, a product such as dry cereal may require an inner membrane or pouch within a single-walled container. Absent a rigid and separate inner liner, the latching means for such containers would engage one or more notches only on an external surface of the container.

It is thus seen that the present invention provides an improved latching means over closures of the prior art. As many variations are apparent to one of skill in the art from reading the above specification, such variations are within the spirit and scope of the instant invention as defined by the following appended claims.

That which is claimed:

1. A container having a recloseable closure with reversible latching means, said container comprising:

a top;

a bottom;

a front;

a back;

a first side and a second side;

said top hingedly connected to said container said top further comprising an upper surface, an inner surface and a margin, said margin projecting beneath a plane of said inner surface;

a latch having a first end and a second end, said first end positioned against an inner portion of said margin;

a tab, said tab defined by said second end of said latch, said tab being deformable from a plane of said latch, said tab carried below said margin;

a notch defined by an exterior surface of said container;

wherein when said hinged top reversibly engages said container, said tab of said latch is positioned in close proximity to said notch, said tab engaging said notch thereby reversibly securing said recloseable closure to said container.

2. An apparatus for reversibly securing a hinged container closure to an opening of a container comprising:

a latch having a first end and a second end, said first end being secured to an inner surface of said container closure;

a tab defined by an interior portion of said second end, said tab being deformable from the plane of said second latch end and said tab carried below a margin of said closure;

a notch defined by an exterior surface of said container, said notch configured to reversibly receive said tab;

wherein said container closure carrying said latch is placed in a closed position upon said container, said tab of said latch positioned in close proximity to said notch, said tab engaging said notch thereby reversibly securing said closure to said container opening.

3. The apparatus of claim 1 wherein said latch is carried by a handle, said handle providing means for carrying said container.

4. The apparatus according to claim 1 wherein said latch is die stamped from a resilient plastic.

5. The apparatus according to claim 3 wherein said latching apparatus and said handle are of unitary one piece construction.

6. An apparatus for reversibly securing a hinged container closure to an opening in a container comprising:

a latch having a first end and a second end, said first end being secured to an inner surface of said container closure;

a first tab and a second tab, said first and said second tab each being defined by an interior portion of said second latch end;

a first notch and a second notch, said first and said second notch defined by an exterior surface of said container, said first and said second notch configured to be engaged by said first and said second tab respectively, said second tab carried below a margin of said closure;

wherein said container closure carrying said latch is placed in a closed position upon said container, said first tab and said second tab of said latch positioned in close proximity to said first notch and said second notch respectively, said tabs engaging said notches thereby reversibly securing said closure to said container opening.

7. The apparatus according to claim 6 wherein said first notch is engaged by a first tab, said first notch defined by a liner of said carton.

8. A sealable container having a tear-away portion for revealing a hinged lid comprising;

a container, said container having a hinged lid, said lid further comprising an upper surface, an inner surface and a margin, said margin projecting beneath a plane of said inner surface;

a latch having a first end and a second end, said first end positioned against an inner portion of said lid margin;

a tab, said tab defined by said second end of said latch, said tab being deformable from a plane of said latch, said second end of said latch being positioned in a stored position between an inner liner of said container and an exterior wall of said container, said latch being released from said stored position by the initial opening of said sealable container;

a notch defined by an exterior portion of said container;

wherein when said hinged top reversibly engages said container, said tab of said latch is positioned in close proximity to said notch, said tab engaging said notch thereby reversibly securing said recloseable closure to said container.

9. A handle and latch assembly for a container comprising:

a substantially planar platform, said platform having a top, a bottom, an outer perimeter, and an inner region, said platform further defining an opening providing communication between said top platform surface and said bottom platform surface;

a strap defined by said inner region, said strap traversing said opening and having a first end and a second end, said first and said second ends attached to a flexible hinge at both of said respective ends;

a latch carried by said handle, said latch providing a tab for reversibly securing a notch defined by said container;

wherein said platform is fastened to said container, said opening providing access to said strap, said flexible hinge permitting said strap to be reversibly engaged thereby permitting said strap to be grasped, said tab of said latch engaging said notch thereby reversibly securing said lid to said container.

* * * * *